US010091863B2

(12) United States Patent
Erdmann et al.

(10) Patent No.: US 10,091,863 B2
(45) Date of Patent: Oct. 2, 2018

(54) EXTERNAL CONTROL LIGHTING SYSTEMS BASED ON THIRD PARTY CONTENT

(71) Applicant: PHILIPS LIGHTING HOLDING B.V., Eindhoven (NL)

(72) Inventors: Bozena Erdmann, Aachen (DE); Esko Olavi Dijk, Utrecht (NL); Theodorus Jacobus Johannes Denteneer, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 14/913,671

(22) PCT Filed: Aug. 27, 2014

(86) PCT No.: PCT/IB2014/064090
§ 371 (c)(1),
(2) Date: Feb. 22, 2016

(87) PCT Pub. No.: WO2015/036886
PCT Pub. Date: Mar. 19, 2015

(65) Prior Publication Data

US 2016/0212830 A1 Jul. 21, 2016

(30) Foreign Application Priority Data

Sep. 10, 2013 (EP) ..... 13183665

(51) Int. Cl.
*H05B 37/02* (2006.01)

(52) U.S. Cl.
CPC ..... *H05B 37/0272* (2013.01); *H05B 37/02* (2013.01)

(58) Field of Classification Search
CPC .. H05B 37/0272; H05B 37/02; H05B 37/029; H05B 37/0245; H05B 33/0863;
(Continued)

(56) References Cited

U.S. PATENT DOCUMENTS 5,465,115 A * 11/1995 Conrad ..... G06K 9/00778 348/155
5,769,527 A * 6/1998 Taylor ..... G05B 19/0421 315/316
(Continued)

FOREIGN PATENT DOCUMENTS

CN 101485233 A 7/2009
CN 101904222 A 12/2010
(Continued)

*Primary Examiner* — Haissa Philogene

(57) ABSTRACT

A computing system (200) and a method of generating data for enabling external control of a lighting system (100) comprising a plurality of light sources (101, 102) based on third party content are provided. The computing system is configured to receive a plurality of registrations of lighting systems and, for each of the registered lighting systems, information including indications of positions of at least some of the light sources of the lighting system, and to map the information onto a coordinate system. A coordinate-based representation is generated based on the mapping. Further, the computing system is configured to receive third party content from an external third party content provider (300), select at least one of the registered lighting systems, and generate data for controlling the selected lighting system. The generation of data is based on the coordinate-based representation related to the selected lighting system and the third party content.

17 Claims, 2 Drawing Sheets

(58) Field of Classification Search
CPC ..... H05B 33/0803; H05B 33/0818; H05B 33/0872; H02J 13/0034; H02J 13/0037; H02J 13/001; G06Q 30/0201
USPC ..... 315/294, 307, 312, 129–136; 705/7.29
See application file for complete search history.

(56) References Cited

U.S. PATENT DOCUMENTS 6,006,158 A * 12/1999 Pilley ..... G01C 23/00 340/953
7,231,060 B2 * 6/2007 Dowling ..... H04S 5/005 382/100
7,502,034 B2 * 3/2009 Chemel ..... H05B 37/029 345/594
8,314,569 B2 * 11/2012 Adamson ..... H05B 37/029 315/291
8,405,323 B2 * 3/2013 Finney ..... H05B 37/0245 315/130
9,204,523 B2 * 12/2015 Reed ..... H05B 33/0863
9,332,620 B2 * 5/2016 Shin ..... H05B 37/0227
9,648,699 B2 * 5/2017 Jobe ..... H05B 37/0218
9,860,965 B2 * 1/2018 Recker ..... H05B 37/0272
2002/0198728 A1 12/2002 Bruning
2004/0174326 A1 9/2004 Yamamoto et al.
2010/0303290 A1 * 12/2010 Mathe ..... G06T 17/05 382/103
2011/0115413 A1 * 5/2011 Erickson ..... H05B 37/029 315/312
2012/0091918 A1 * 4/2012 Snijder ..... G06F 3/1446 315/312
2012/0143684 A1 * 6/2012 Park ..... G06Q 30/02 705/14.49
2012/0310703 A1 * 12/2012 Cavalcanti ..... G06Q 30/0201 705/7.29

FOREIGN PATENT DOCUMENTS

JP 2011018864 A 1/2011
WO 2007099318 A1 9/2007
WO 2009081329 A1 7/2009
WO 2009122356 A1 10/2009
WO 2012090142 A1 7/2012
WO 2012112813 A2 8/2012
WO 2013121311 A1 8/2013

* cited by examiner

EXTERNAL CONTROL LIGHTING SYSTEMS BASED ON THIRD PARTY CONTENT

CROSS-REFERENCE TO PRIOR APPLICATIONS

This application is the U.S. National Phase application under 35 U.S.C. § 371 of International Application No. PCT/IB2014/064090, filed on Aug. 27, 2014, which claims the benefit of European Patent Application No. 13183665.2, filed on Sep. 10, 2013. These applications are hereby incorporated by reference herein.

FIELD OF THE INVENTION

The present invention generally relates to the field of external control of lighting systems. In particular, the present invention relates to generating data for enabling control of at least one lighting system, based on third party content.

BACKGROUND OF THE INVENTION

As technology lighting is developing, the capabilities of lighting systems increase. Modern lighting systems used e.g. in commercial, industrial and residential spaces may utilize centralized control and network-based communication in order to manage advanced control of the lighting system. A lighting system may e.g. be controlled to adapt the illumination to certain ambient conditions and increase energy efficiency.

Conventionally, a lighting system (or part of a lighting system) is used for one dedicated purpose, such as for office illumination or for illuminating a specific outdoor area. At certain hours of the day, the lighting system may be unutilized. For example, a lighting system for office illumination may be partly (or entirely) turned off outside of office hours.

SUMMARY OF THE INVENTION

It would be advantageous to enable an extended range of applications of lighting systems. In particular, it would be desirable to enable an external party to utilize at least one lighting system.

To better address one or more of these concerns, a computing system and a method having the features defined in the independent claims are provided. Preferable embodiments are defined in the dependent claims.

Therefore, according to a first aspect, a computing system for generating data for enabling external control of at least one lighting system based on third party content is provided. The computing system is configured to receive a plurality of registrations of lighting systems, each lighting system comprising a plurality of light sources. The computing system is further configured to receive, for each of the registered lighting systems, information including indications of positions of at least some of the light sources of the lighting system, and to map the information onto a coordinate system, the mapping including associating each indicated position with at least one coordinate of the coordinate system. Further, the computing system is configured to generate at least one coordinate-based representation of the registered lighting systems, based on the mapping. The coordinate-based representation comprises the coordinates with which the indicated positions are associated. Further, the computing system is configured to receive third party content from at least one external third party content provider, select at least one of the registered lighting systems, and generate data for controlling the at least one selected lighting system. The generation of data is based on the at least one coordinate-based representation related to the selected lighting system and the third party content.

According to a second aspect, a method of generating data for enabling external control of at least one lighting system based on third party content is provided. The method comprises receiving a plurality of registrations of lighting systems, each lighting system comprising a plurality of light sources. The method further comprises, for each of the registered lighting systems, receiving information including indications of positions of at least some of the light sources of the lighting system, and mapping the information onto a coordinate system, the mapping including associating each indicated position with at least one coordinate of the coordinate system. The method further comprises generating at least one coordinate-based representation of the registered lighting systems, based on the mapping. The coordinate-based representation comprises the coordinates with which said indicated positions are associated. Further, the method comprises receiving third party content from at least one external third party content provider, selecting at least one of the registered lighting systems, and generating data for controlling the at least one selected lighting system. The generation of data is based on the at least one coordinate-based representation related to the selected lighting system and the third party content.

The present aspects enable, an external third party content provider, to utilize one or more (e.g. independently controllable) registered lighting systems in order to convey (or render) third party content. The third party content provider may not necessarily have to communicate directly with one or multiple lighting systems (and owners of lighting systems) to get access to a convenient lighting system. The third party content may e.g. be related to advertisements, graphical icons or other types of messages, highlighting of such messages, or serve a decorative purpose. Further, a lighting system owner is enabled to register his/her lighting system to allow another party to make use of the lighting system, e.g. for another purpose than the primary purpose of the lighting system, such as during hours when the lighting system is not needed for its primary purpose. Consequently, the present aspects are advantageous in that they enable an extended range of applications of lighting systems.

The layout (or architecture) of a lighting system is normally rather irregular and may vary greatly between different lighting systems, which implies a challenge if lighting systems are to be utilized for rendering third party content. Thus, conventional techniques for rendering content by means of an illumination device having a regular grid layout (such as a screen) or by means of a border having a linear layout around such an illumination device (which may be referred to as Ambilight) may not simply be applied directly. With the present aspects, at least one coordinate-based representation is generated by mapping information including indications of positions of at least some of the light sources of the registered lighting systems onto a coordinate system. The coordinate-based representation facilitates generating data for controlling different kinds of lighting systems, since the coordinate-based representation provides a representation of the layout of one or more lighting systems according to a predetermined structure. Consequently, rendering third party content by means of differently configured lighting systems is facilitated.

For example, at least one coordinate-based representation may be generated for each registered lighting system, and/or a single coordinate-based representation may be generated for several registered lighting systems.

The computing system as defined in accordance with the first aspect may include one or more computing devices (such as processors or computers) configured to perform (or, in the case of a plurality, configured to cooperate to perform) the method in accordance with the second aspect. For example, the present aspects may be realized by means of cloud computing.

In the present specification, the term "owner of a lighting system" is to be widely interpreted as anyone who may represent a specific lighting system, such as someone who is capable of transmitting a registration of the lighting system and/or information about the lighting system. For example, it may be someone who is authorized to provide, to an external party, secured access (such as controlling light sources of the lighting system and/or retrieving a list of available light sources that can be controlled) over a communication network to the lighting system.

According to an embodiment, the selection of the at least one of the registered lighting systems may be based on the third party content. For example, a registered lighting system or registered lighting systems capable of rendering the third party content according to certain quality parameters may be selected. For example, the third party content may require (or specify) one or more of: a minimum resolution (or amount) of light sources, one or more specific light source colors, a specific geographic location of the lighting system and/or of the public able to view the lighting system (e.g. defined by GPS coordinates or an approximate area), and a specific time period (such as hours) when the third party content is to be rendered. The selection of a registered lighting system may take these requirements into account and a lighting system having e.g. at least the given minimum resolution, light sources that are capable of emitting the specified color, etc. may be selected. The present embodiment enables enhanced rendering of the third party content.

According to an embodiment, the computing system may be external to the lighting systems. Further, the method in accordance with the second aspect may be performed external to the lighting systems. Therefore, the computing system and method may be independent of (and, hence, not integrated with, or built into) any of the lighting systems. Thus, the computing system may be an independent portal for receiving registrations of lighting systems from external lighting system owners, as well as third party content from external third party content providers, and for taking the necessary measures (generating the coordinate-based representation and control data) to enable rendering of third party content by means of one or more of the registered lighting systems.

According to an embodiment, the computing system may be configured to transmit the generated control data via an interface of the selected lighting system. Therefore, the method may comprise transmitting the generated control data via an interface of the selected lighting system. The interface (which e.g. may be an application programming interface, API) may be configured to allow external control of the lighting system. Hence, the computing system may be configured to communicate with lighting systems having such an interface, which facilitates external control of the lighting systems.

According to an embodiment, the information (including indications of positions of at least some of the light sources of the lighting system) may include at least one image depicting at least a part of the lighting system (such as at least some light sources of the lighting system). For example, the image may be provided by the owner of the lighting system, optionally upon registration of the lighting system. In the present specification, the term "at least one image" is to be widely interpreted and may e.g. include a photographic image, an image of a computer model of the lighting system and/or a video containing multiple images. The positions of the at least some of the light sources are indicated by the depictions of the light sources in the image. The present embodiment is advantageous in that providing the information including indications of positions of light sources of the lighting system is facilitated, as the owner (or any other party) may capture a picture (or video) of the lighting system to obtain the information and, thus, may not necessarily have to know any specific coordinates of the light sources of the lighting system in advance.

Further, mapping the information may comprise superimposing the coordinate system on the at least one image and performing image analysis of the at least one image for identifying the positions of the at least some of the light sources indicated by the at least one image relative to the coordinate system. Hence, the position of a light source depicted in the at least one image may be detected by means of image analysis, and the detected position may then be associated with a coordinate of the coordinate system superimposed over the image.

According to an embodiment, the information (including indications of positions of at least some of the light sources of the lighting system) may include predefined coordinates of the at least some of the light sources. For example, the owner of a lighting system may provide such information if such information is available for the lighting system. The predefined coordinates do not necessarily have to be coordinates of the same coordinate system as the coordinate system used for the coordinate-based representation to be generated, but may be expressed in a different coordinate system. Further, mapping the information may comprise superimposing the predefined coordinates on the coordinate system (i.e. the coordinate system to be used for the coordinate-based representation of the lighting system), wherein the predefined coordinates subsequently may be associated with the coordinates of the coordinate system. In this way, the predefined coordinates may be translated into coordinates of the coordinate system to be used for the coordinate-based representation of the lighting system.

According to an embodiment, the mapping may include associating each indicated position with the closest at least one coordinate of the coordinate system (i.e. with the coordinate, or coordinates, located closest to each indicated position). Therefore, the coordinates of the light sources in the coordinate-based representation of the lighting system may, at least roughly, reflect (or correspond to) the actual positions of the light sources within the lighting system, which enables improved rendering of the third party content by means of a registered lighting system. The closest coordinate may e.g. be the closest coordinate in an integer representation (which results in a more roughly estimated position of a light source) or in a floating point representation (which results in a more precisely estimated position of a light source). A floating point coordinate may indicate (at least almost) the exact position of a light source.

According to an embodiment, the mapping may be made with respect to at least two different viewing angles relative to the lighting system, and the coordinate-based representation may be three-dimensional. For example, the information including indications of the positions of the at least some of the light sources may comprise two images (or two sets of images) depicturing the lighting system from different viewing angles, and/or predefined coordinates defining a three-dimensional position of each light source. Further, the coordinate system of the coordinate-based representation may be a three-dimensional coordinate system. The present embodiment enables three-dimensional rendering of third party content by means of the selected lighting system. Further, it may enable rendering two-dimensional third party content such that it is visible (or makes a complete picture or message) from a specific viewing angle.

According to an embodiment, the coordinate system may include at least one of a grid coordinate system and a border coordinate system. The grid coordinate system may be two- or three-dimensional, wherein one position is indicated by two or three coordinates, respectively. A border coordinate system may be a linear (one-dimensional) coordinate system, wherein one position is indicated by a single coordinate. A border coordinate system may e.g. be used for utilizing the selected lighting system to be controlled based on third party content in an Ambilight-like manner.

According to an embodiment, the computing system may be further configured to provide data for controlling the at least one selected lighting system to turn on each one of the at least some of the light sources. Hence, the method may comprise providing data for controlling the at least one selected lighting system to turn on each one of the at least some of the light sources. Further, the information may include indications of the positions of the light sources which have been turned on. Thus, the computing system may aid the process of obtaining (or collecting) information including indications of positions of the at least some of the light sources of the lighting system. For example, the lighting system may be controlled (by the computing system) to turn on all or some of the light sources desired to be used for rendering the third party content, thereby allowing an owner of the lighting system to capture an image of the lighting system indicating the positions of the light sources being turned on. Optionally, the light sources may be turned on one by one (i.e. one at the time), and one image may be captured per light source being turned on.

According to an embodiment, a computer program comprising instructions for enabling at least one processor to carry out the method as defined in any one of the preceding embodiments is provided. According to an embodiment, a computer program product comprising a computer-readable medium, on which a computer program as defined in the previous embodiment is stored, is provided. For example, the computer program and/or the computer program product may be implemented in the computing system.

It is noted that embodiments of the invention relate to all possible combinations of features recited in the claims. Further, it will be appreciated that the various embodiments described for the computing system can all be combined with the method as defined in accordance with the second aspect.

Further objectives of, features of, and advantages with, the present aspects will become apparent when studying the following detailed disclosure, the drawings and the appended claims. Those skilled in the art realize that different features of the present embodiments can be combined to create embodiments other than those described in the following.

BRIEF DESCRIPTION OF THE DRAWINGS

These and other aspects will now be described in more detail, with reference to the appended drawings showing embodiments.

All the figures are schematic, not necessarily to scale, and generally only show parts which are necessary in order to elucidate embodiments of the invention, wherein other parts may be omitted or merely suggested.

DETAILED DESCRIPTION

Figure 1:
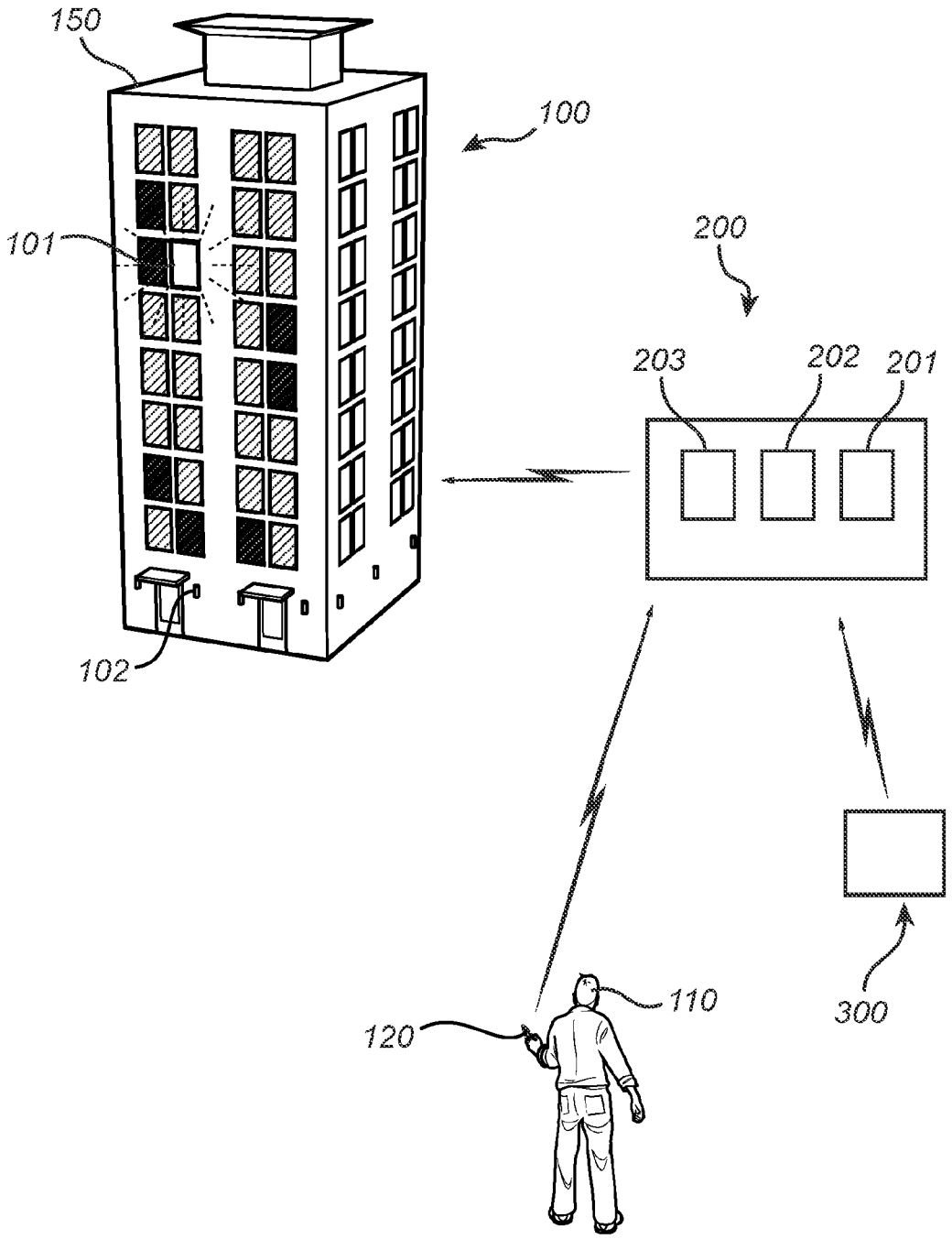
FIG. 1 illustrates a lighting system, a third party content provider and a computing system according to an embodiment.

FIG. 1 shows a lighting system 100 comprising a plurality of light sources 101, 102. The lighting system 100 may be dedicated to providing illumination for a specific space, such as in the present example, a building 150. The lighting system 100 may e.g. comprise light sources 101 for indoor office illumination and light sources 102 for outdoor floodlighting. One light source 101, 102 may be constituted of a group of luminaires for illuminating a specific region, such as a group of luminaires for illuminating one room of the building 150, and/or a light emitting surface, such as a window of an illuminated room, and/or simply of a single luminaire. The lighting system 100 may further comprise a centralized control unit (not shown) for controlling the light sources 101, 102. The control unit may preferably comprise an interface allowing external control of the lighting system 100, such as an API (application programming interface). For example, the lighting system 100 may be able to be externally controlled according to an IP (Internet protocol)-based standardized lighting control and management protocol and/or a Web Service-based lighting control and management protocol, which may be defined in addition to a CoAP (constrained application protocol) or a HTTP (hypertext transfer protocol) application protocol. Further, the control unit may preferably be connectable to a communication network, such as the Internet and/or a telecommunication network. For example, the lighting system 100 may be an IP, BACnet (building automation and control networks) or KNX-based lighting system. Further, FIG. 1 shows a computing system 200, which may comprise a receiving unit 201 for receiving data (or information) from external providers/devices, a computing unit 202 for processing data, and a transmitting unit 203 for transmitting data (or information) to external providers/devices. The units 201, 202, 203 may be implemented as software modules, hardware modules, firmware modules, or a combination thereof. The computing system 200 may comprise one or more computing devices (computers), in which the units 201, 202, 203 may be implemented. Further, the computing system 200 may be connectable, e.g. via the receiving unit 201 and the transmitting unit 203, to a communication network, such as the Internet and/or a telecommunication network. In the following, the computing system 200 will be referred to as a portal 200.

Furthermore, FIG. 1 shows an external third party content provider 300. The term "external" in the phrase "external third party content provider" 300 is to be taken to mean that it is external to the computing system 200 and to the lighting system 100. The external third party content provider 300 may be any actor interested in conveying or rendering content. Such content may in the following be referred to as third party content and may e.g. be related to advertisements, any kind of messages and/or aesthetic effects.

In the following, a method 500 of enabling external control of the lighting system 100 (and other lighting systems), based on third party content according to an embodiment, will be described with reference to FIG. 1 and FIG. 2.

Figure 2:
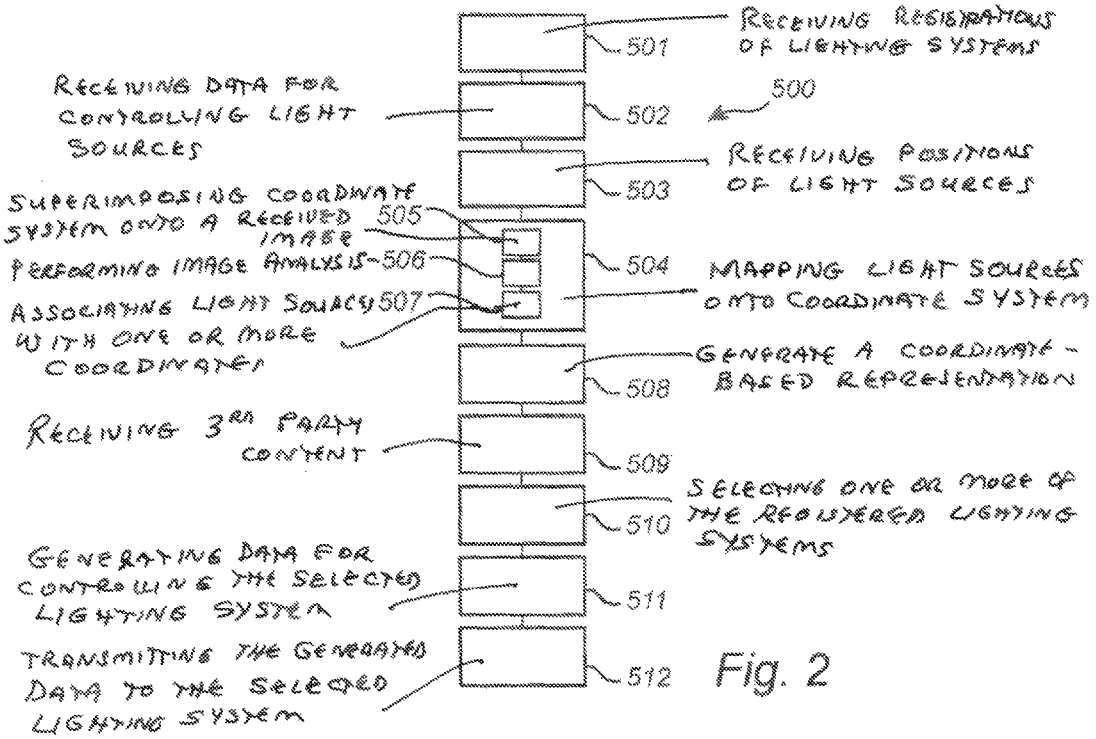
FIG. 2 illustrates a mapping procedure according to an embodiment.

FIG. 2 is a schematic illustration of the method 500. The portal 200 may be configured to perform the method 500. The method 500 may e.g. be realized by a computer program (optionally comprising one or more software modules) comprising instructions for enabling one or more processors (e.g. of the portal 200) to carry out the method 500.

Owners of lighting systems may be able to register their lighting system at the portal 200. For example, an owner 110 may, via a communication network, transmit a registration of the lighting system 100, which is received 501 and stored by the portal 200 (such as by the receiving unit 201). The portal 200 may further receive 501 and store registrations of several other lighting systems. A registration may include information about the lighting system 100, such as descriptions of available light sources 101, 102, and hours when the lighting system 100 can be utilized by an external party. Alternatively (or additionally), the registration of a lighting system 100 may enable the portal (e.g. at a later occasion) to fetch information about the lighting system 100, e.g. by means of a discovery protocol, so as to discover (or retrieve information regarding) available devices (such as light sources) to be controlled. Examples of such discovery protocols are: DNS-SD (domain name services service discovery), SSDP (simple service discover protocol), WS-Discovery (web services dynamic discovery) and CoRE Resource Directory.

Further, information including indications of positions of the light sources 101, 102 of the lighting system 100 may be transmitted to and received 503 (and stored) by (optionally together with the registration) the portal 200 (such as the receiving unit 201). The information may e.g. be provided in the form of an image (or a set of images) depicturing at least a part of the lighting system 100. For example, the owner (or any other person) 110 may take a picture (or video) of the lighting system 100 with a camera or a smartphone 120 and send the picture to the portal 200, optionally upon registration of the lighting system 100 at the portal 200. Optionally, the geographical position (such as the GPS position) where the picture (or video) was captured by the camera or smartphone 120, and/or information related to the orientation of the camera or smartphone 120 when the picture or video was captured, may be transmitted together with the image to the portal 200. Alternatively, the image may be an image of a computer model of the lighting system 100.

In an embodiment, the portal 200 may be configured to provide 502 data for controlling the lighting system 100 to turn on each one of the light sources 101, 102. The data may be transmitted to the lighting system 100 (such as to the centralized controller of the lighting system 100), which in turn controls the light sources 101, 102 to be switched on. With the light sources 101, 102 switched on, the owner 110 may capture one or more images of the lighting system 100. Subsequently, the one or more images depicturing the light sources 101, 102, which have been switched on, may be sent to and received 503 by the portal 200. According to an embodiment, the portal 200 may provide data for controlling the light sources 101, 102 of the lighting system 100 to be (successively) turned on, one (or one group of light sources 101, 102) at a time. The owner 110 may then capture one image per light source 101, 102 (or group of light sources 101, 102) being turned on, and subsequently transmit the images to the portal 200. According to a further example, the portal 200 may control the lighting system 100 to switch on a light source e.g. for one second. The smartphone 120 may then capture a video of this event at e.g. 50 or 60 frames per second, allowing 50 or 60 images to be transmitted to the portal 200, which provides more thorough information about the locations of the light sources 101, 102 for further analysis by the portal 200.

Alternatively, or additionally, the owner 110 may provide the information in the form of a set of predefined coordinates of the light sources 101, 102, if such predefined coordinates are available for the owner 110. Alternatively, the portal 200 may retrieve such information from the lighting system 100, e.g. by sending a request to the lighting system 100, which may transmit the information to the portal 200 in response to the request. The predefined coordinates may be coordinates of an arbitrary coordinate system, or of one or more predefined coordinate systems accepted by the portal 200.

Further, the portal 200 (such as the computing unit 202 of the portal 200) may map 504 the information including indications of the light sources 101, 102 onto a specific coordinate system. The mapping 504 may comprise associating each indicated position with at least one coordinate of the coordinate system.

Figure 3:
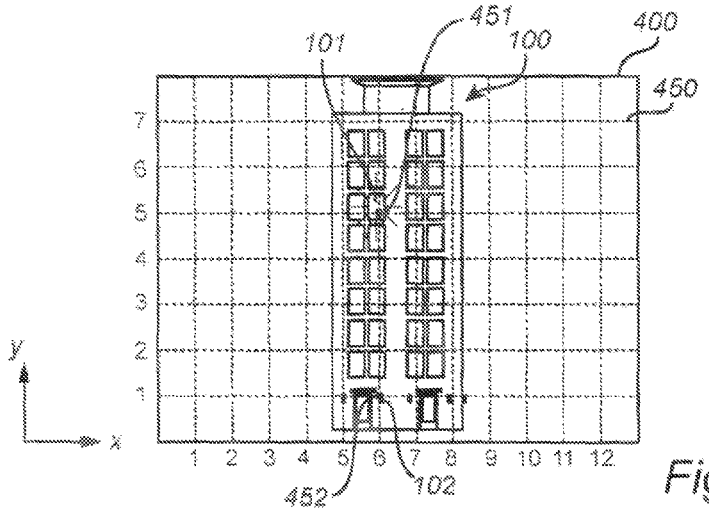
FIG. 3 illustrates a method according to an embodiment.

In case the information is provided in the form of at least one image 400, the mapping 504 may comprise superimposing 505 the specific coordinate system 450 on the image 400, as illustrated in FIG. 3. Image analysis of the image 400 may then be performed 506 (e.g. by the computing unit 202) for identifying the positions of the light sources 101, 102 indicated by the image 400 relative to the coordinate system 450, such that each light source 101, 102 may be associated 507 with one or more coordinates of the coordinate system 450, and preferably with the closest one or more coordinates of the coordinate system 450. In the present example, the coordinate system 450 is a grid coordinate system defined by x- and y-axes, and one light source 101 is associated 507 (or paired) with the integer coordinates 451 (x=6, y=5), and another light source 102 is associated 507 (or paired) with the integer coordinates 452 (x=6, y=1) during the mapping procedure. Alternatively, each light source 101, 102 may be associated with at least one floating point coordinate, which may more precisely correspond to the actual position of the light source 101, 102.

In case the information is provided in the form of a video or a set of multiple images, the image analysis may be performed on multiple images so as to better estimate the position of the light sources 101, 102.

Further, the mapping 504 may take into account information related to the orientation and/or position of the camera or smartphone 120 when the image 400 was captured. For example, the resolution and/or size of the coordinate system may be adapted to such information.

In case the information is provided in the form of a set of predefined coordinates of the light sources 101, 102, the mapping 504 may comprise superimposing the predefined coordinates on the specific coordinate system (not shown). The predefined coordinates may then be associated (or paired) with the closest one or more coordinates of the specific coordinate system. The coordinate system of the predefined coordinates is not necessarily the same as the specific coordinate system on which the predefined coordinates are superimposed. When superimposing the predefined coordinate system on the specific coordinate system, information such as GPS location of the origin of the predefined coordinate system and/or a scaling factor for estimating distance in meters from coordinate values (e.g. for translating predefined coordinate (4, 3) to (20 meter, 15 meter)

relative to an origin). Such information may be provided by the lighting system 100 (or the owner 110 of the lighting system 100).

As a result of the mapping procedure, a coordinate-based representation is generated 508 by the portal 200 (such as by the computing unit 202 of the portal 200), which comprises the estimated coordinates of the light sources 101, 102 of the lighting system 100.

Optionally, several images may be provided with respect to several different viewing angles of the lighting system 100 and the mapping 504 may be made with respect to the several different viewing angles. The coordinate-based representation of the generated 511 lighting system 100, based on the mapping 504, may then be three-dimensional.

The above described steps of receiving 503 information, mapping 504 the information onto the coordinate system and generating 508 the coordinate-based representation may preferably be performed for each registered lighting system. The coordinate-based representations of the lighting systems may be stored at the portal 200 (or at any external storage).

The external third party content provider 300 may transmit third party content (e.g. via the communication network) to the portal 200 (such as to the receiving unit 201 of the portal 200), which may receive 509, and preferably store, the third party content. The portal 200 may then select 510 one or more of the registered lighting systems 100, preferably based on the third party content. For example, the selection 510 of a lighting system may be based on the type of third party content and/or on specific requirements stated by the third party content, such as requirements on minimal resolution/amount of light sources, location (and optionally orientation) of the lighting system, time when the third party content is desired to be displayed and/or color of the light sources. The portal 200 may then generate 511 data for controlling the one or more selected lighting systems 100, based on the coordinate-based representation of the selected lighting systems 100 and the third party content. The data may then be transmitted 512 (such as by the transmitting unit 203 of the portal 200) to the selected lighting systems 100 (such as to the controller of the lighting systems 100), preferably via the API of the lighting systems 100. The controller of the selected lighting systems 100 may then control the light sources 101, 102, based on the transmitted 512 data.

If the coordinate-based representation is of a sufficiently high resolution and e.g. represented by floating point coordinates for the light sources 101, 102, and the third party content is related to e.g. an icon (or any other kind of message or content) defined by a plurality of pixels, the computing system 200 may be configured to find, for each pixel, the closest light source 101, 102 (or group of light sources), based on the floating point coordinates, and select the closest light source 101, 102 (or group of light sources) to render the pixel. Further, a single light source 101, 102 may represent several pixels if the third party content pixel resolution is higher than the resolution of light sources in the one or more selected lighting systems.

In an embodiment, the mapping 504 procedure may further comprise assessing color similarity and/or brightness similarity between different registered lighting systems and/or with respect to predefined (standard) values. Color rendering and brightness output may differ between different lighting systems. For example, the command "brightness 50%" may lead to different light outputs in different lighting systems and the command "green" may lead to light output of different green color tones in different lighting systems. The data for controlling the one or more selected lighting systems may then comprise instructions to compensate for deviations in color rendering and/or brightness from other selected lighting systems and/or from the predefined values. Optionally, the result of the color similarity and/or brightness similarity assessment may be comprised in the coordinate-based representation.

With the above described embodiments, lighting system owners 110 are able to lend or rent their lighting system 100 for the purpose of rendering (or conveying) third party content. In an embodiment, the registration of a lighting system 100 may indicate which hours the lighting system 100 will be available for rendering third party content, such as outside of office hours in case the lighting system 100 is primarily used for office illumination. Optionally, the owners 110 may get some kind of compensation for lending their lighting system 110. Hence, the lighting system 100 may be externally controlled, based on the third party content, e.g. for highlighting a message on a display (external to, or integrated in the lighting system 100), for conveying a message or for providing an aesthetic effect. For example, the lighting system 100 may be used as a large display, wherein the light sources 101, 102 may correspond to large pixels of the display. The third party content may be static or dynamic, and therefore the light sources 101, 102 may be statically or dynamically controlled.

While embodiments of the invention have been illustrated and described in detail in the drawings and foregoing description, such illustration and description are to be considered illustrative or exemplary and not restrictive; the invention is not limited to the disclosed embodiments.

For example, the lighting system may be any kind of lighting system, such as any indoor or outdoor illumination system. The lighting systems may not necessarily have a centralized controller for communication with the portal. Instead, each light source (or luminaire) may be able to communicate with the portal (e.g. by means of IP based communication), whereby individual control of each light source is enabled without a centralized controller. Further, different parts of the method and the computing system may be implemented on different devices. As an example, the mapping procedure may be implemented by an application on a smartphone and the generation of data may be implemented by a centralized server (or computing device). Furthermore, the providing of information including indications of positions of the light sources may not necessarily be performed by the lighting system owner, but by anyone having access to such information. Moreover, the coordinate system on which the coordinate-based representation of the lighting system is based, may be any kind of coordinate system, such as the above described grid coordinate system or a border (or one-dimensional) coordinate system.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measures cannot be used to advantage. A computer program may be stored/distributed on a suitable medium, such as an optical storage medium or a solid-state medium supplied together with or as part of other hardware, but may also be distributed in other forms, such as via the Internet or other wired or wireless telecommunication systems. Any reference signs in the claims should not be construed as limiting the scope.

The invention claimed is:

1. A computing system for generating data for enabling external control of at least one lighting system, based on third party content, the computing system being configured to:

receive a plurality of registrations of lighting systems, each lighting system comprising a plurality of light sources, for each of the registered lighting systems, receive information including indications of positions of at least some of the light sources of the lighting system, for each of the registered lighting systems, map said information onto a coordinate system the mapping including associating each indicated position with at least one coordinate of the coordinate system, generate at least one coordinate-based representation of the registered lighting systems based on the mapping, the at least one coordinate-based representation comprising the coordinates with which said indicated positions are associated, receive third party content from at least one external third party content provider, select at least one of the registered lighting systems, and generate data for controlling the at least one selected lighting system, wherein the generation of data is based on the at least one coordinate-based representation related to the selected lighting system and the third party content.

2. The computing system as defined in claim 1, wherein the selection of the at least one of the registered lighting systems is based on the third party content.

3. The computing system as defined in claim 1, wherein the computing system is external to the lighting systems.

4. The computing system as defined in claim 1, the computing system being further configured to transmit the generated control data via an interface of the selected lighting system, the interface being configured to allow external control of the lighting system.

5. The computing system as defined in claim 1, wherein said information includes at least one image depicting at least a part of the lighting system.

6. The computing system as defined in claim 5, wherein mapping said information comprises superimposing the coordinate system on the at least one image and performing image analysis of the at least one image for identifying the positions of the at least some of the light sources indicated by the at least one image relative to the coordinate system.

7. The computing system as defined in claim 1, wherein said information includes predefined coordinates of the at least some of the light sources.

8. The computing system as defined in claim 7, wherein mapping said information comprises superimposing the predefined coordinates on the coordinate system.

9. The computing system as defined in claim 1, wherein the mapping includes associating each indicated position with the closest at least one coordinate of the coordinate system.

10. The computing system as defined in claim 1, wherein the mapping is made with respect to at least two different viewing angles relative to the lighting system, and wherein the coordinate-based representation is three-dimensional.

11. The computing system as defined in claim 1, wherein the coordinate system includes at least one of a grid coordinate system and a border coordinate system.

12. The computing system as defined in claim 1, the computing system being further configured to: provide data for controlling the at least one selected lighting system to turn on each one of the at least some of the light sources, wherein said information includes indications of the positions of the light sources which have been turned on.

13. The computing system as defined in claim 1, wherein the received third party content comprises one or more quality parameters; said quality parameters being selected from the group consisting of: a minimum resolution, a minimum amount of light sources, specific light source colors, and combinations thereof.

14. A method of generating data for enabling external control of at least one lighting system, based on third party content, the method comprising:

receiving a plurality of registrations of lighting systems, each lighting system comprising a plurality of light sources, for each of the registered lighting systems, receiving information including indications of positions of at least some of the light sources of the lighting system, for each of the registered lighting systems, mapping said information onto a coordinate system, the mapping including associating each indicated position with at least one coordinate of the coordinate system, generating at least one coordinate-based representation of the registered lighting systems based on the mapping, the at least one coordinate-based representation comprising the coordinates with which said indicated positions are associated, receiving third party content from at least one external third party content provider, selecting at least one of the registered lighting systems, and generating data for controlling the at least one selected lighting system, wherein the generation of data is based on the at least one coordinate-based representation related to the selected lighting system and the third party content.

15. A computer program product comprising a non-transient computer-readable medium, on which a computer program is stored; the computer program comprising instructions for enabling at least one processor to carry out the method as defined in claim 14.

16. The method of claim 14, wherein the received third party content comprises one or more quality parameters; said quality parameters being selected from the group consisting of: a minimum resolution, a minimum amount of light sources, specific light source colors, and combinations thereof.

17. A computing system for generating data for enabling external control of at least one lighting system, based on third party content, the computing system being configured to:

receive a plurality of registrations of lighting systems, each lighting system comprising a plurality of light sources, for each of the registered lighting systems, receive information including indications of positions of at least some of the light sources of the lighting system, for each of the registered lighting systems, map said information onto a coordinate system the mapping including associating each indicated position with at least one coordinate of the coordinate system, generate at least one coordinate-based representation of the registered lighting systems based on the mapping, the at least one coordinate-based representation comprising the coordinates with which said indicated positions are associated, receive a third party content message from at least one external third party content provider, select at least one of the registered lighting systems, and generate data for controlling the at least one selected lighting system, wherein the generation of data is based on the at least one coordinate-based representation related to the selected lighting system and the third party content message.

* * * * *